United States Patent [19]

Williams

[11] Patent Number: 4,582,123

[45] Date of Patent: Apr. 15, 1986

[54] CENTRAL DEHUMIDIFICATION (TANDEM) SYSTEM

[76] Inventor: Roger Williams, 628 4th St., Belpre, Ohio 45714

[21] Appl. No.: 640,245

[22] Filed: Aug. 13, 1984

Related U.S. Application Data

[63] Continuation of Ser. No. 349,560, Feb. 17, 1982, abandoned.

[51] Int. Cl.[4] ..... F24F 3/14

[52] U.S. Cl. ..... 165/21; 62/176.6; 165/48.1; 236/44 C

[58] Field of Search ..... 165/21, 48; 236/44 R, 236/44 A, 44 C; 62/176.1, 176.6, 93, 510

[56] References Cited

U.S. PATENT DOCUMENTS

| | | | |
|---|---|---|---|
| 3,352,352 | 11/1967 | Walters | 165/21 |
| 3,385,349 | 5/1968 | MacLeod | 165/21 |
| 3,758,368 | 9/1973 | Trask | 165/21 |
| 3,989,097 | 11/1976 | Schildknecht | 236/44 C |
| 4,051,691 | 10/1977 | Dawkins | 62/510 |
| 4,183,224 | 1/1980 | Rule, III et al. | 62/93 |
| 4,271,898 | 6/1981 | Freeman | 165/16 |
| 4,350,023 | 9/1982 | Kuwabara | 236/443 |

*Primary Examiner*—Sheldon J. Richter
*Assistant Examiner*—Randolph A. Smith
*Attorney, Agent, or Firm*—Edwin E. Greigg

[57] ABSTRACT

A central dehumidification system that will work in tandem with a furnace and a central air conditioner or as a single unit. The aforementioned central dehumidification tandem system is separate and independent of the air conditioner. The controls for operation of the central dehumidifier include a control unit which operates in conjunction with the air conditioner such that the central dehumidifier will not operate during operation of theair conditioner.

6 Claims, 2 Drawing Figures

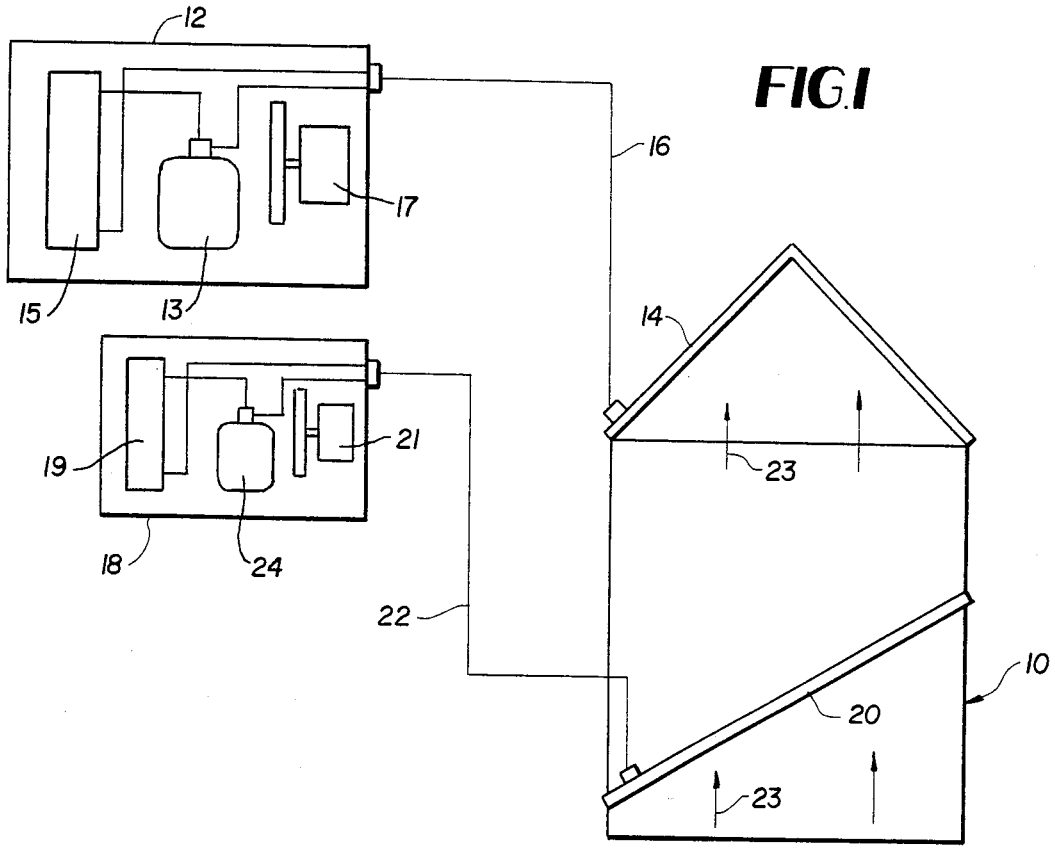
FIG. 1
FIG. 2
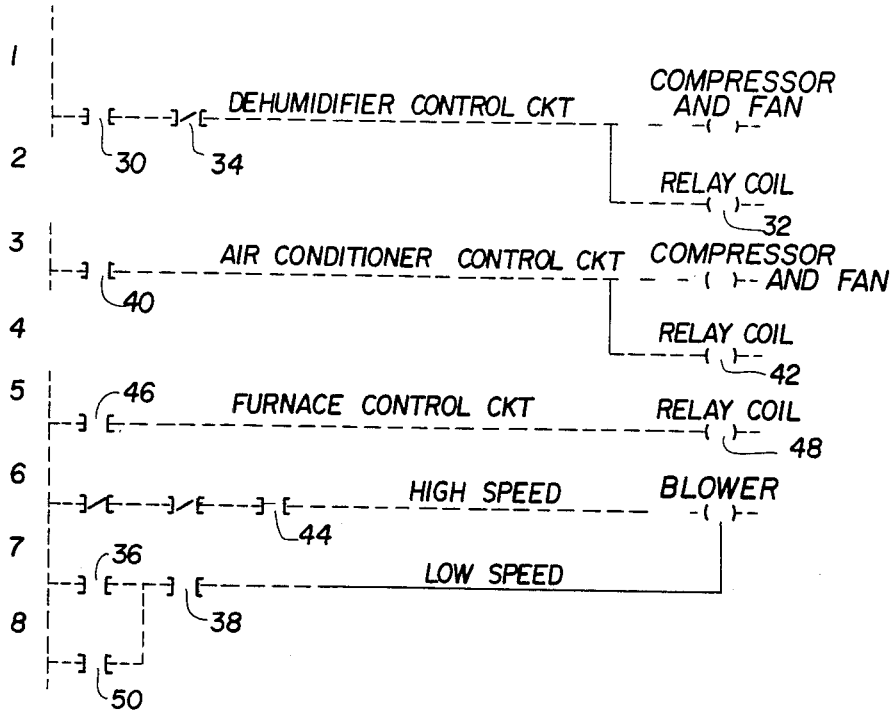

CENTRAL DEHUMIDIFICATION (TANDEM) SYSTEM

This is a continuation of copending application Ser. No. 349,560 filed Feb. 17, 1982 now abandoned.

BACKGROUND OF THE INVENTION

This invention relates to dehumidification systems and more particularly to a central dehumidification system which is in tandem with a central air conditioner system and operative in conjunction with a hot air furnace duct system.

Heretofore, dehumidification of different rooms in a building has been carried out by use of single dehumidifier units placed in the area to be dehumidified. This requires more than one unit for controlling an entire building. Systems have also been used with heater duct systems in conjunction with a central air conditioner. Various types of such systems have been set forth in the prior art in U.S. Pat. Nos. 3,385,349; 3,758,368; 3,927,712; 3,989,097; and 4,271,898. These systems are costly to operate because they include electric heaters that operate in conjunction with the central air conditioner. With an emphasis on saving energy, there is a desire for systems that can save energy.

OBJECTS AND SUMMARY OF THE INVENTION

It is therefore an object of the present invention to provide a dehumidification system in conjunction with a central air conditioner and hot air furnace blower which will not only save electrical energy but will function to lessen the workload of a central air conditioner unit.

Another object is to reduce wear and potential maintenance cost on a central air conditioner unit by requiring less operation time for cooling a desired area due to a higher operating temperature setting of the air conditioner controls.

Still another object is to provide a dehumidification system that can function for cooling purposes on slightly warm, humid days without operation of the central air conditioner system.

BRIEF DESCRIPTION OF THE DRAWINGS

FIG. 1 is a schematic drawing looking inside the housings illustrating a dehumidification tandem system.

FIG. 2 illustrates a solid state control system for the heater blower, air conditioner and dehumidifier.

DETAILED DESCRIPTION OF THE PREFERRED EMBODIMENTS

With reference to FIG. 1, there is shown a schematic air conditioner and dehumidifier in combination with a heater furnace 10. The combination of an air conditioner with a heater furnace is well known in the art and includes a housing 12 on the outside of the building which houses the usual compressor 13, condenser 15 and fan 17 associated with the compressor and condenser. The flow of refrigerant from the compressor—condenser to the cooling coil 14 in the furnace unit and from the cooling coil to the compressor is conducted through the usual refrigerant feed and return lines 16.

The dehumidifier is similar to the air conditioner and includes a housing 18 outside the building which could be near the air conditioner housing 12 or contained within the air conditioner housing as a separate system in combination with the conditioner compressor and condenser. The same fan for the air conditioner could function for cooling the dehumidifier compressor and condenser.

The refrigerant from the compressor 24—condenser 19 of the dehumidifier to the evaporator coil 20 of the dehumidifier and from the dehumidifier evaporator coil to the compressor is through refrigerant feed and return lines 22. Cooling is by fan 21. The furnace includes a variable speed blower (not shown) that forces air through the evaporator and cooling coil as shown by the arrows 23.

The wiring for operation and control of air conditioner—heating units is well known in the art. Heavy duty circuitry carries the high current necessary to operate the heavy duty equipment such as the compressors and fans for the air conditioner and the dehumidifier and the variable speed blower for the furnace. The air conditioner and dehumidifier fans cool the compressors and condensors for the air conditioner and dehumidifier and the furnace variable speed blower is used for heating, cooling and dehumidification purposes of the building. Electrical control equipment is matched with the power wiring and includes low voltage for the controls which are coupled with power switching arrangements to thereby enable a low voltage control circuit to operate at a safe level while easily controlling the higher amperage power equipment. Such control circuits may be solid state or a conventional relay circuitry which would be well known to anyone skilled in the control art.

FIG. 2 illustrates a solid state control which is suitable for control and operation of the furnace blower at low speed, the air conditioner at high furnace blower speed and the dehumidifier at low fan speed.

As shown, line 1 of the drawing FIG. 2 illustrates the humidistat 30 which controls the dehumidifier control relay 32 shown in line 2 which controls the supply current to the compressor 19 and fan 21. Switch 34 is in series with the humidistat and is automatically closed when the air conditioner is not operating. Closing of the humidistat also automatically closes the contact 36 (line 7) for the low speed control of the furnace blower. The control line to the low speed control also shows a contact 38 which is automatically opened when the air conditioner is operating and automatically closed when the air conditioner is not operating.

The control for the air conditioner is shown in lines 3 and 4. The thermostat 40 automatically closes the air conditioner circuit control relay 42 which operates the compressor 15 and fan 17 and automatically closes contact 44 for the high speed circuit of the furnace blower. Simultaneously the switch 34 in the dehumidifier control line and the contact 38 in the low speed control circuit are automatically opened to prevent the dehumidifier and furnace blower from operating at low speed during operation of the air conditioner. As soon as the thermostat 40 opens the control circuit to the air conditioner, the switch control 34 in the dehumidifier circuit and the switch control or contact 38 in the low speed control circuit are automatically closed.

Lines 5 through 8 of FIG. 2 show the furnace control circuit. The thermostat control 46 for the furnace blower control relay 48 controls the heating operation. When the thermostat closes the control circuit to the furnace, the contact 50 (line 8) automatically closes to operate the blower for the furnace at low speed. The furnace blower does not operate at high speed with the furnace since the element 44 is open because the air conditioner is not operating. As shown, the furnace blower only operates at high speed when the air conditioner is operating and the furnace blower only operates at slow speed when the dehumidifier or the furnace is operating. However, the controls could be fixed so that the furnace blower could operate at low or high speed with any desired unit.

In operation of the control system, the air conditioner and furnace have their individual thermostat controls and the dehumidifier operates by use of a separate humidistat. The operation is as follows: in the summer or hot-warm months, the heater furnace control circuit is turned off and the air conditioner and dehumidifier control circuits are turned on. The air conditioner has its own control circuit and the dehumidifier has its own control circuit to a humidistat. The control circuit for the dehumidifier is controlled by the air conditioner control circuit. The dehumidifier is then controlled by the humidistat. When the air conditioner control reaches the setting for operation of the air conditioner, the control circuit to the humidistat opens to break the circuit to the humidistat; therefore, the dehumidifier will not operate simultaneously with the air conditioner. The air conditioner relay closes to operate the compressor and fan in the air conditioner housing, and automatically closes the high speed control to the furnace blower for operation of the furnace blower. When desired room temperature has been reached, the air conditioner thermostat turns the air conditioner off, the control circuit for the humidistat is automatically closed and the relay to the air conditioner simultaneously opens the high speed control to the high speed blower fan.

The humidistat controls the dehumidifier; therefore, when the humidity reaches the % humidity setting of the humidistat the humidistat control closes which closes the relay to the dehumidifier and closes the contact control for the low speed control for the furnace blower. Since the circuit to the humidistat which controls the dehumidifier closes upon opening of the circuit to the air conditioner, the dehumidifier operates as soon as the air conditioner stops if the humidity is high enough or as soon as the humidity reaches the setting of the humidistat which controls the dehumidifier.

During operation of the air conditioner, the cooled refrigerant is directed from the compressor—condenser from outside the building to the cooling coils 14 in the furnace. The furnace blower operates at high speed blowing air through the cooling coils which cools the air as it passes the cooling coils. The cooled air is then directed through the usual duct work to the different rooms and returned to the blower for a continuous operation. During operation of the air conditioner, the control circuit to the humidistat is opened so that the dehumidifier will not operate.

When the control circuit for the air conditioner opens to shut down the air conditioner, the circuit to the humidistat is automatically closed. When the humidity is high enough to close the humidistat control, the dehumidifier will operate. Operation of the humidistat for controlling the dehumidifier closes the contact to the low speed circuit of the blower which blows air through the evaporator coil which cools the air as it blows through the evaporator. The air is circulated through the duct system into the different rooms and returned in the same manner as for the air conditioner and heater. Operation of the dehumidifier is much less costly than that of the air conditioner. As long as the air conditioner is not operating, the dehumidifier will operate, as needed, to control the humidity in the different rooms; that is, the dehumidifier functions independent of the air conditioner and will operate in intervals as controlled by the humidistat. Since the dehumidifier operates independent of the air conditioner to control the humidity, the control setting of the air conditioner can be set at a higher temperature setting because the room would feel cooler with less humidity at a higher temperature.

In carrying out this invention, the evaporator coil of the dehumidifier is designed to be placed in association with a furnace suitable for air conditioning without any alteration of the furnace or air conditioner cooling coils. The dehumidifier evaporator could be placed downstream of the air conditioner cooling coils as well as upstream relative thereto in which case the air would be directed through said evaporator coils. In addition, the dehumidifier evaporator coil could be placed on the return air side of the furnace in which case the air would be pulled through said evaporator coils. The important thing is that the air movement from the furnace blower pass through the evaporator coils of the dehumidifier before entering the duct system.

The dehumidifier compressor and condenser are housed in a separate housing from that of the air conditioner, as shown. This makes it possible for those who already have air conditioning to add a dehumidifier in tandem with the air conditioner without disturbing the air conditioner. Such an addition only requires making a small aperture in the foundation or wall of the building for the feed and return lines of the dehumidifier and to add the evaporator to the furnace. This can be done without disturbing the air conditioner outside of the building.

For new construction in which air conditioning has not yet been installed, the dehumidifier, compressor and condenser can be assembled in the housing with the air conditioner compressor and condenser to take advantage of the same fan or the dehumidifier could even have a separate fan which would not be as large as the fan for the air conditioner. In the latter case, all of the elements outside of the building would be in one housing rather than in two different housings, as shown. The system as shown could be used for old construction in which the dehumidifier is added to the air conditioner furnace system or to new construction in which the air conditioner and dehumidifier are separate devices used in combination in the furnace.

Obviously with such a system, the dehumidifier can be used on cool days for cooling where it feels too cool for air conditioning but too warm for pleasant comfort. Such use would avoid the high energy cost of operating an air conditioner which requires considerably more energy to operate than that of a dehumidifier.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A dehumidifier system for a heater furnace-air duct system within a building in which:

said dehumidifier system includes an evaporator coil positioned in said furnace so that air from a blower in said furnace is directed through said evaporator coil and directed into said duct system as required for dehumidification during periods other than during air conditioning and heating, said dehumidifier system and an air conditioner system associated with said furnace each includes separate compressor—condensers within the same housing outside said building area to be cooled and dehumidified, said separate compressor—condenser of said dehumidifier refrigerant includes feed and return lines connected between the compressor—condenser and said evaporator coil in said furnace, an air conditioner cooling coil in said furnace through which air from said blower in said furnace is directed for air conditioning a desired enclosed area;

said separate compressor—condenser of said air conditioner system includes refrigerant feed and return lines connected between the compressor—condenser and said cooling coil in said furnace, said evaporator coil of said dehumidifier is placed in said furnace independent of and upstream from said air conditioner cooling coil; and said system includes a control system that allows said dehumidifier system to operate only when said air conditioner system and said furnace are not operating.

2. A dehumidifier system as claimed in claim 1 in which:

said air from said blower is forced through said evaporator coil from the return air side of the furnace and then directed through said duct system as required for dehumidification during periods other than during heating and air conditioning.

3. A dehumidifier system as claimed in claim 1 in which:

said air conditioner system includes a control which opens a control circuit to said dehumidifier system which prevents operation of said dehumidifier during operation of said air conditioner and during heating periods.

4. A dehumidifier system for a heater furnace-air duct system within a building in which:

said dehumidifier system includes an evaporator coil positioned in said furnace so that air from a blower in said furnace is directed through said evaporator coil and directed into said duct system as required for dehumidification during periods other than during air conditioning and heating, said dehumidifier system includes a compressor—condenser in a separate dehumidifier housing outside of said building area to be dehumidified;

further including refrigerant feed and return lines connected between said dehumidifier compressor—condenser and said evaporator coil, said air conditioner system associated with said furnace includes a compressor—condenser in a separate housing outside of said building area to be cooled and dehumidified, an air conditioner cooling coil in said furnace through which air from said blower in said furnace is directed for air conditioning a desired enclosed area, further including refrigerant feed and return lines between said air conditioner compressor—condenser and said cooling coil, said evaporator coil of said dehumidifier is placed in said furnace independent of and upstream from said air conditioner coil, and said system includes a control system that allows said dehumidifier system to operate only during periods when said air conditioner system and said furnace are not operating.

5. A dehumidifier system as claimed in claim 4 in which:

said air from said blower is forced through said evaporator coil from the return air side of the furnace and then directed through said duct system as required for dehumidification during nonheating and noncooling periods.

6. A dehumidifier system as claimed in claim 4, in which said air conditioner system includes a control which opens a control circuit to said dehumidifier system which prevents operation of said dehumidifier during operation of said air conditioner and during heating periods.

* * * * *